US007871716B2

(12) United States Patent
Vance

(10) Patent No.: US 7,871,716 B2
(45) **Date of Patent: *Jan. 18, 2011**

(54) DAMAGE TOLERANT GAS TURBINE COMPONENT

(75) Inventor: Steve James Vance, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1293 days.

This patent is subject to a terminal disclaimer.

(21) Appl. No.: 11/642,119

(22) Filed: Dec. 20, 2006

(65) Prior Publication Data

US 2010/0260960 A1 Oct. 14, 2010

Related U.S. Application Data

(63) Continuation-in-part of application No. 10/423,528, filed on Apr. 25, 2003, now Pat. No. 7,198,860.

(51) Int. Cl.
*B32B 18/00* (2006.01)

(52) U.S. Cl. ..... 428/701; 428/697; 428/698; 428/699; 428/702; 416/224; 416/229; 416/97 A

(58) Field of Classification Search ..... None
See application file for complete search history.

(56) References Cited

U.S. PATENT DOCUMENTS 3,430,898 A * 3/1969 Parechanian et al. ..... 244/121
4,023,322 A * 5/1977 Hughes ..... 52/608
4,124,732 A 11/1978 Leger
4,308,309 A 12/1981 Leiser et al.
4,713,275 A * 12/1987 Riccitiello et al. ..... 428/76
4,728,262 A * 3/1988 Marshall ..... 416/224
4,928,575 A 5/1990 Smirlock et al.
5,170,690 A 12/1992 Smirlock et al.
5,191,166 A 3/1993 Smirlock et al.
5,331,816 A 7/1994 Able et al.
5,404,793 A 4/1995 Myers
H1434 H 5/1995 Cytron
5,489,074 A * 2/1996 Arnold et al. ..... 244/159.1
5,636,508 A 6/1997 Shaffer et al.
5,639,531 A 6/1997 Chen et al.
5,660,885 A 8/1997 Hasz et al.
5,683,825 A 11/1997 Bruce et al.
5,856,252 A 1/1999 Lange et al.
5,957,067 A 9/1999 Dobbeling et al.

(Continued)

OTHER PUBLICATIONS

LAST®Armor description page. LAST® Armor is a registered trademark of LAST® Armor, Inc. Subsidiary of Foster-Miller, Inc, Waltham, MA, 1995.

*Primary Examiner*—Aaron Austin

(57) ABSTRACT

A damage tolerant component (90) for use in a high temperature combustion gas environment. The component includes a plurality of ceramic tiles (94) bonded to a substrate (92) for isolating any impact damage to the damaged tile(s). A grout (98) may fill gaps between adjacent tiles to blunt any crack tip extending from a damaged tile. Ceramic tile insulation may be applied in two layers (56, 58) with the material properties of the two layers being different, such as with a bottom layer selected for its thermal insulating properties and a top layer selected for its impact resistance properties. A layer of sealing material (100) may be applied over at least a portion of the ceramic tiles.

11 Claims, 4 Drawing Sheets

U.S. PATENT DOCUMENTS

| | | | | |
|---|---|---|---|---|
| 5,972,819 | A | 10/1999 | Cohen | |
| 6,013,592 | A * | 1/2000 | Merrill et al. | 501/80 |
| 6,174,565 | B1 | 1/2001 | Daws et al. | |
| 6,197,424 | B1 | 3/2001 | Morrison et al. | |
| 6,224,339 | B1 * | 5/2001 | Rhodes et al. | 416/224 |
| 6,287,511 | B1 | 9/2001 | Merrill et al. | |
| 6,322,322 | B1 | 11/2001 | Rhodes et al. | |
| 6,332,390 | B1 | 12/2001 | Lyons | |
| 6,358,002 | B1 | 3/2002 | Good et al. | |
| 6,365,281 | B1 | 4/2002 | Subramanian et al. | |
| 6,670,046 | B1 | 12/2003 | Xia | |
| 6,676,783 | B1 * | 1/2004 | Merrill et al. | 156/89.11 |
| 6,703,137 | B2 | 3/2004 | Subramanian | |
| 6,716,539 | B2 | 4/2004 | Subramanian | |
| 6,733,907 | B2 * | 5/2004 | Morrison et al. | 428/699 |
| 6,746,755 | B2 | 6/2004 | Morrison et al. | |
| 6,974,624 | B2 | 12/2005 | Mulligan et al. | |
| 6,982,126 | B2 | 1/2006 | Darolia et al. | |
| 6,991,432 | B2 * | 1/2006 | Williams | 416/186 R |
| 7,008,674 | B2 | 3/2006 | Nagaraj et al. | |
| 7,083,824 | B2 | 8/2006 | Stankowski et al. | |
| 7,104,751 | B2 | 9/2006 | Naik et al. | |
| 2002/0178900 | A1 | 12/2002 | Ghiorse et al. | |

* cited by examiner

DAMAGE TOLERANT GAS TURBINE COMPONENT

This application is a continuation-in-part of U.S. application Ser. No. 10/423,528 filed 25 Apr. 2003 and issued as U.S. Pat. No. 7,198,860.

FIELD OF THE INVENTION

This invention relates generally to the field of power generation, and more particularly to the hot gas path components of a combustion turbine engine, and specifically to ceramic insulating tiles applied over portions of a gas turbine component.

BACKGROUND OF THE INVENTION

It is known to apply a ceramic insulating material over the surface of a component that is exposed to gas temperatures that exceed the safe operating temperature range of the component substrate material. Metallic combustion turbine (gas turbine) engine parts (e.g. nickel, cobalt, iron-based alloys) are routinely coated with a ceramic thermal barrier coating (TBC), for example as described in U.S. Pat. No. 6,365,281 issued to the present inventor, et al., and assigned to the present assignee. Such coatings are generally deposited by a vapor deposition or thermal spray process.

The firing temperatures developed in combustion turbine engines continue to be increased in order to improve the efficiency of the machines. Ceramic matrix composite (CMC) materials are now being considered for applications where the temperature may exceed the safe operating range for metal components. U.S. Pat. No. 6,197,424, assigned to the present assignee, describes a gas turbine component fabricated from CMC material and covered by a layer of a dimensionally stable, abradable, ceramic insulating material, commonly referred to as friable grade insulation (FGI). Hybrid FGI/CMC components offer great potential for use in the high temperature environment of a gas turbine engine, however, the full value of such hybrid components has not yet been realized due to their relatively recent introduction to the gas turbine industry.

DETAILED DESCRIPTION OF THE INVENTION

Figure 1:
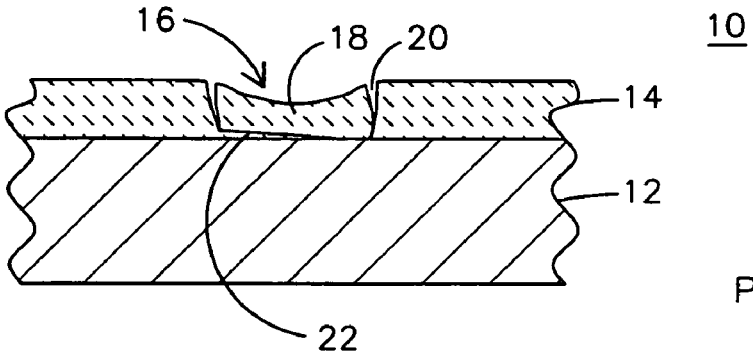
FIG. 1 PRIOR ART
FIG. 1 is a partial cross-sectional view of a component of a gas turbine engine utilizing a prior art thermal insulation system showing debris impact damage.

Components of a gas turbine engine are exposed to a corrosive, high temperature environment, and they must be able to withstand the erosion and impact effects of a high velocity combustion gas stream. A prior art gas turbine component 10 is shown in partial cross-section in FIG. 1. The component 10 includes a substrate material 12 protected by an overlying layer of ceramic insulating material 14. The substrate material 12 may be, for example, a cobalt or nickel based superalloy or a ceramic matrix composite (CMC) material. A bonding material may be deposited between the substrate 12 and the insulating material 14 to improve the adhesion there between. The bonding material may be a layer of MCrAlY alloy (not shown), where M may be Fe, Co, Ni or mixtures thereof for metal substrates, and it may be a ceramic adhesive for CMC substrates.

The insulating layer 14 may be exposed to impact by high-energy particles propelled by the combustion gas stream. An impact crater 16 is visible in the insulating layer 14. The major damage mechanisms that result from such surface impacts are a crush zone 18 directly under the site of the impact, thru-thickness cracking 20 caused by in-plane tensile stress in the area immediately surrounding the crush zone 18, and delamination 22 of the insulating material 14 from the substrate 12 caused by rebound stresses across the interface. The extent of such damage will depend not only upon the energy and size of the impacting particle, but also will depend upon the particular material composition and mechanical properties of the insulating material 14. Material properties of the insulating material 14 are often a compromise among conflicting parameters, and materials that are optimized for resisting erosion may be relatively brittle and more susceptible to impact damage.

Figure 2:
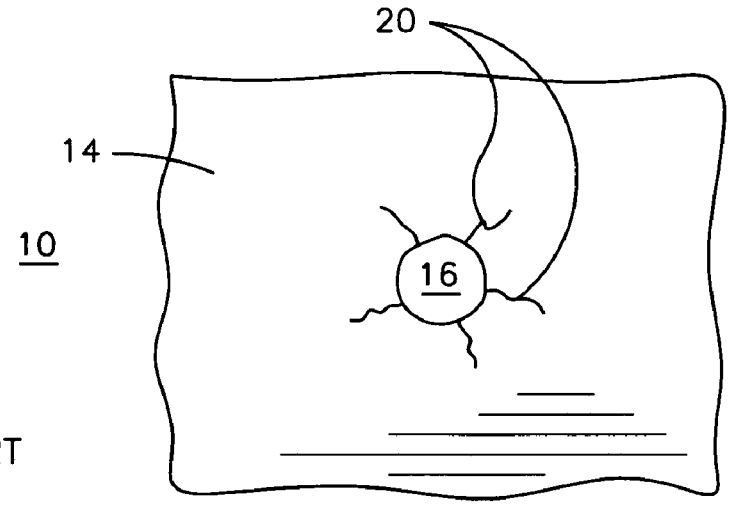
FIG. 2 PRIOR ART
FIG. 2 is a partial plan view of the prior art component of FIG. 1.

FIG. 2 is a plan view of the component of FIG. 1 showing the lateral extent of the cracking 20 that may be caused by impact damage. Prior art ceramic insulating material 14 is deposited as a monolith, i.e. as a large single layer of material covering an entire surface of the substrate that is exposed during the deposition or bonding process. Such a monolith may be susceptible to the progression of cracking 20 and/or delamination 22 due to the stress concentration existing at the crack tip, thereby resulting in degradation of the insulating layer 14 over an area significantly larger than the area of the actual impact crater 16.

Figure 3:
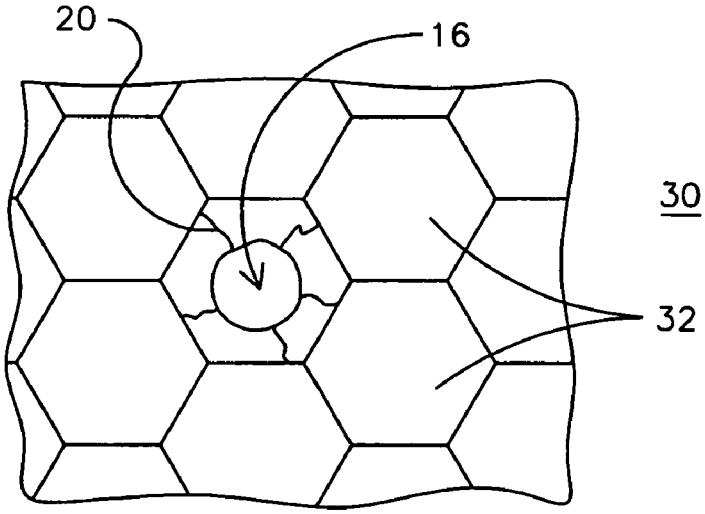
FIG. 3 is a partial plan view of a component of a gas turbine engine utilizing a plurality of individual ceramic insulating tiles.
Figure 4:
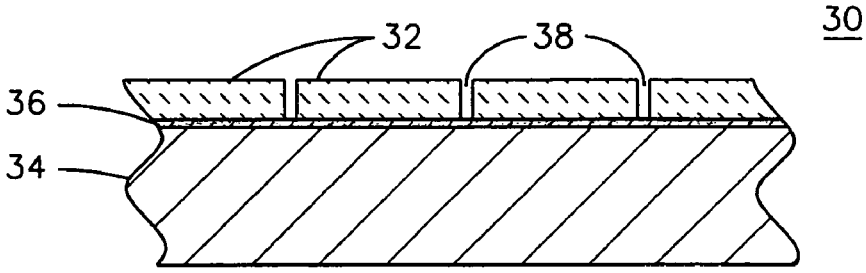
FIG. 4 is a partial cross-sectional view of the component of FIG. 3

A damage tolerant component 30 for a gas turbine engine or other high temperature application is illustrated in plan view in FIG. 3 and in partial cross-section in FIG. 4. Component 30 includes a plurality of individual tiles 32 of ceramic insulating material. Each tile 32 is bonded to the surface of a substrate 34 by a high temperature ceramic-based adhesive 36. The adhesive may be in the form of a ceramic slurry, frit slurry, sol-gel, reaction bonding adhesive, or self-propagating high temperature reaction adhesive. An oxide-based paste adhesive 36 may be reinforced with chopped ceramic fibers, ceramic platelets or equiaxed ceramic particles to customize its important properties, such as strength, elastic modulus, conductivity and coefficient of thermal expansion. The selection of adhesives useful in bonding individual tiles may be greater than the selection available for bonding large monolithic shapes due to the smaller contiguous area that must be bonded. Shrinkage typically occurs in an adhesive layer during a bonding process. The bonding of a large non-flat monolithic structure will result in three-dimensional shrinkage-induced strain that may lead to high residual stresses and premature failure of the bond. Small, flat or nearly flat tiles can be applied with less sensitivity to shrinkage. Small tiles are constrained in the plane parallel to the bond line, but they are unrestrained in the perpendicular direction. Consequently, the residual stresses caused by shrinkage are minimized. The tiles 32 may cover the entire surface of the component, or the entire surface of the component that is exposed to a harsh environment, or to only a portion of the surface of a component.

Substrate 34 may be any appropriate structural material, for example an alloy material, a ceramic material, or composite material such as an oxide/oxide CMC material. Tiles 32 may be any appropriate insulating material, for example a friable grade insulation (FGI) as described in the above-cited '424 patent. Because the individual tiles 32 are separated from each other by gaps 38, any damage or cracking 20 associated with an impact crater 16 will not progress to any adjacent tile that is not actually struck by the impacting object. Because the gaps 38 function as a crack-tip limiter, the specific chemical and mechanical properties of the ceramic material used to form the tiles 32 may be optimized for erosion and/or another selected property with less concern needed for properties that affect impact damage containment. For example, the tiles 32 may be selected to be a ceramic insulating material that has purposefully increased strength and hardness when compared to alternatives, while the corresponding increase in brittleness and decreased impact resistance is of reduced concern since crack propagation and delamination are limited to individual tiles 32.

Figure 5:
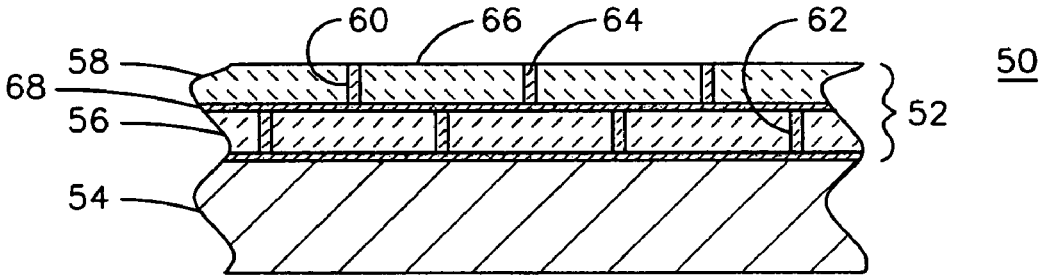
FIG. 5 is a partial cross-sectional view of a component of a gas turbine engine utilizing a two-layer coating of individual ceramic insulating tiles.
Figure 6:
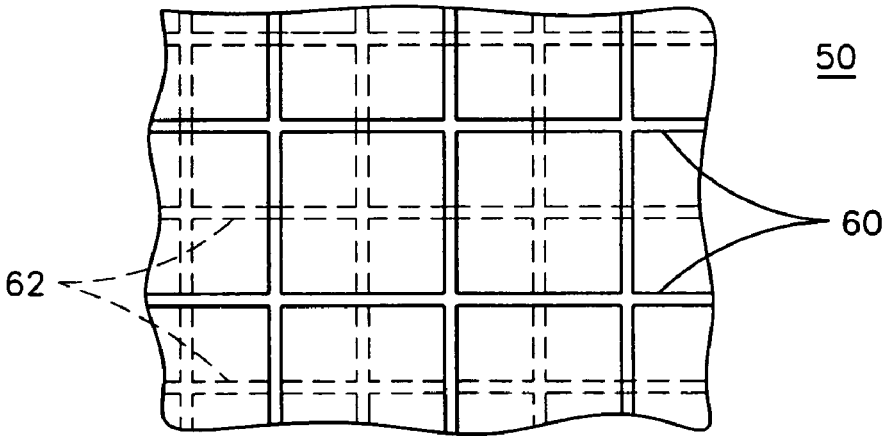
FIG. 6 is a partial plan view of the component of FIG. 5.

FIGS. 5 and 6 illustrate a damage tolerant gas turbine engine component 50 having an insulating layer 52 disposed over a substrate 54. In this embodiment, the insulating layer 52 includes a first layer of ceramic insulating tiles 56 bonded to a surface of the substrate 54 and a second layer of ceramic insulating tiles 58 bonded to the first layer of tiles 56. An adhesive may be used to bond the individual tiles as in the single layer embodiment of FIG. 4. In the present invention the insulating layer 52 may be thicker than prior art insulating layers, and may be in the range of 2-10 mm for curved surface applications such as airfoils and even thicker for flat applications, such as to a thickness of 50 mm. In one embodiment, two layers of 2 mm thick tiles are used to achieve an insulating layer thickness of 4 mm on a combustion turbine vane airfoil. The pattern of gaps 60 between adjacent tiles of the second layer of ceramic insulating tiles 58 may be staggered in relation to the pattern of gaps 62 between adjacent tiles of the first layer of ceramic insulating tiles 56 (shown in phantom in FIG. 6) in order to minimize the extent of thru-thickness gaps.

The material selected for the first layer of tiles 56 may be different than that selected for the second layer of tiles 58. For example, the first layer 56 may be formed from a ceramic insulating material that optimizes its thermal insulating characteristics, while the second layer 58 may be formed from a ceramic insulating material that optimizes its erosion resistance properties. An inner layer 56 may be formed with aluminum phosphate, aluminosilicate or other low modulus matrix material that is compatible with the substrate 54 but that is somewhat prone to erosion and environmental attack, such as from water vapor in a combustion gas. An outer layer 58 that is more erosion resistant, e.g. alumina, stabilized zirconia, stabilized hafnia, but is more prone to impact damage would benefit from having the inner tile layer 56 act as a compliant layer. Additional layers of insulating tiles may be used, or a single layer of insulating tiles may be placed over a monolithic layer of insulating material deposited directly onto the substrate. A layer of tiles may be used over a monolithic layer of ceramic insulating material in order to provide thermal shock and/or impact resistance on an outer surface over an environmentally resistant under layer.

A filler material or grout 64 may be deposited in the gaps 60, 62 of either or both layers 56, 58. Grout 64 functions as a barrier to the direct passage of the hot combustion gas and it smoothes the airflow across the top surface 66 of the component 50. Grout 64 may be selected to have mechanical properties that are different than those of the tiles of layers 56, 58. For example, grout 64 may be a ceramic insulating material having an elastic modulus that is lower than that of the tiles and a high damage tolerance, i.e. likely to micro crack instead of macro crack, such as mullite, monozite ($LaPO_4$), sheelite, or submicron blends of multiple phase-stable ceramics such as alumina-zirconia, alumina-hafnia, alumina ceria. The grout 64 also functions to prevent sintering between adjacent tiles, thereby preserving the damage tolerance of the coating. The grout 64 may provide compliance for accommodating thermal growth of the tiles, and it functions to stop the growth of a crack 20 extending to an edge of any tile by absorbing the energy of the crack tip. The grout 64 is typically a material that has less strength than the tile material but is one that bonds well with the tiles. The grout 64 may be layered to have different properties at different locations, such as by using different types of grout 64 for a first layer of tiles 56 and for a second layer of tiles 58.

The insulating tiles 32, 56, 58 of the present invention may be manufactured by net shape casting or by machining from a larger slab of ceramic material. Individual tiles may have a rectangular or square or other shape along their exposed surface and they may be shaped to fit complex substrate surface shapes. A typical tile may be square with sides of 6-50 mm. In one embodiment, a tile is 25 mm by 25 mm by 2 mm in thickness. The tiles may be bonded individually to the substrate 12, 34, 54 or to an underlying layer of tiles 56 by applying adhesive 36 to the back of the tile, to the surface of the substrate, or to both. The individual tiles are then pressed onto the surface of the substrate and a permanent bond is achieved by drying and firing at an elevated temperature, typically 1,000-1,200° C. The tiles can be bonded to the substrate after they have been partially or fully fired to selectively reduce the amount of shrinkage that is experienced by the tiles once they are affixed onto the substrate. Multiple tiles may be attached to a supportive, flexible scrim such as a woven ceramic cloth 68. An entire sheet containing multiple tiles may thus be applied with adhesive as described above to expedite the application process.

Figure 7:
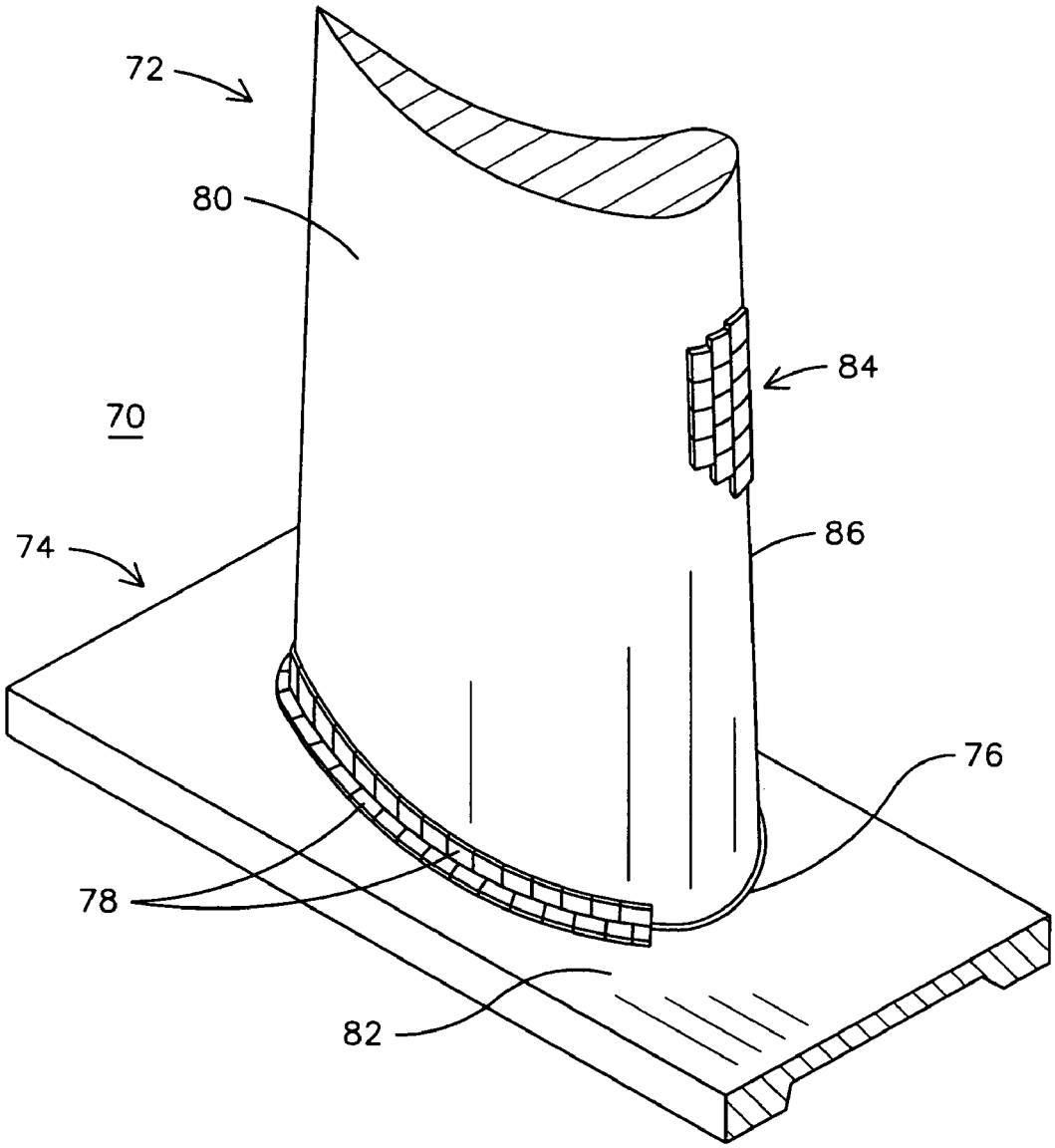
FIG. 7 is a plan view of a gas turbine vane utilizing both monolithic ceramic insulation and a plurality of individual ceramic insulating tiles in selected areas.

FIG. 7 illustrates a combustion turbine stationary vane 70 having an airfoil section 72 and a platform section 74. As is known in the art, a fillet radius 76 is used to reduce stress concentrations at the joint between the two surfaces. This fillet radius 76 may be formed by integral casting, machining, or joining process such as welding. The fillet 76 extends along a joint between the airfoil section 72 and the platform section 74. Although the fillet is sized to help reduce the stress in the joint, the fillet is typically a highly stressed component, and it is a difficult region to cool due to its complex geometry. Furthermore, it is difficult to apply a monolithic ceramic insulating layer to the fillet 76 due to the geometry. A plurality of individual tiles 78 of ceramic insulating material is bonded to the fillet 76 to provide a desired degree of thermal insulation. The tiles 78 may extend to be bonded to areas of the airfoil section 72 and/or platform section 74 proximate the fillet 76. Respective monolithic shapes 80, 82 of ceramic insulating material cover other areas of the airfoil section 72 and platform section 74. The monolithic shapes 80, 82 may be applied to the respective surfaces prior to joining the airfoil section 72 and platform section 74 together. These surfaces are relatively flat and present fewer difficulties when depositing an insulating coating with prior art deposition techniques. After the sections 72, 74 are joined and fillet 76 is formed, the individual tiles 78 of ceramic insulating material are bonded over the fillet 76, with the number and shape of the tiles 78 being selected to mate with the extent of the coverage of the monolithic coatings 80, 82.

Additional ceramic insulating tiles 84 are shown as applied to a portion of a leading edge 86 of the airfoil section 72. These tiles 84 have been installed in an area of the vane 70 that was previously damaged, such as during a manufacturing operation or during in-service use in a combustion turbine engine. A damaged area of the monolithic insulating material 80 has been removed either to a portion of the depth of the monolithic material or completely to the surface of the underlying material which may be a ceramic matrix composite structural ceramic material. At least one tile 84 has been installed in place of the damaged material, with the tile 84 being bonded to the substrate material or to the remaining thickness of the monolithic insulating material. The damaged material may be removed from the surface of the airfoil section 72 by a mechanical operation such as grinding. Additional processes such as milling, grit blasting using dry ice, alumina, silica, quartz, ice, etc. may be used to prepare the surface for bonding. The tiles 84 are then applied with an adhesive and a grout may be applied to fill in any gaps adjacent to the tiles 84. The part is then heated to fully cure the adhesive and grout, as necessary, and the vane 70 is returned to service.

Figure 8:
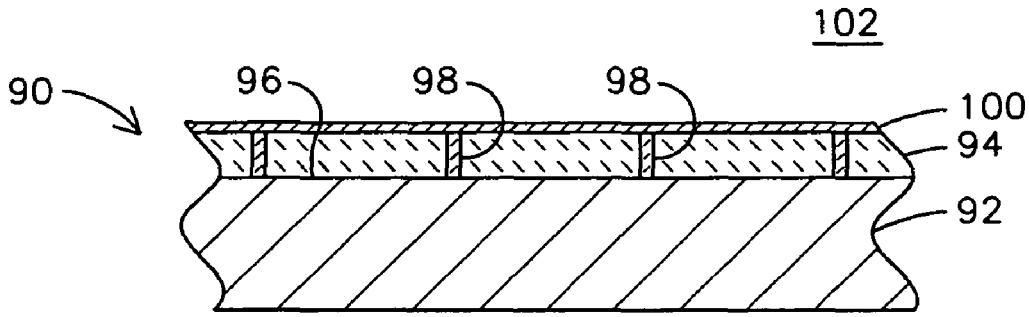
FIG. 8 is a partial cross-sectional view of a damage tolerant component including a layer of ceramic tiles covered by a seal coat material.

FIG. 8 illustrates another embodiment of a damage tolerant component 90 for use in the hot gas flow path of a gas turbine engine. The component 90 includes a substrate 92 that may be an alloy, ceramic or composite material. A layer of ceramic tiles 94 is disposed on at least a portion or all of a surface 96 of the substrate 94. The tiles 94 may be bonded to the surface 96 by a layer of adhesive or metallic braze (not shown) or they may be sintered to the surface 96 if the substrate 92 is a ceramic material. A grout 98 may fill spaces between adjacent tiles 94, and a layer of sealing material 100 is applied over the layer of tiles 94. The layer of tiles 94, grout 98, and the layer of sealing material 100 each provide a different function in making the component 90 damage tolerant. The tiles 94 may provide thermal insulation and a degree of compliance for accommodating thermal expansion, the individual tiles 94 and grout 98 provide mechanical damage tolerance through the isolation and blunting of any crack tip that may develop within the layer of tiles 94, and the sealing material 100 may provide environmental protection and/or erosion protection against the hot combustion gas operating environment 102. The sealing material 100 may contain hafnia and/or alumina in various embodiments. The sealing material should generally have the appropriate temperature capability and chemical resistance for the environment to which it will be exposed, as well as erosion resistance as appropriate. Component 90 may be, for example, a vane, ring segment, combustor basket or transition piece of a gas turbine engine, or other component requiring thermal and/or environmental protection and damage tolerance. The layer of sealing material 100 may be applied over the entire surface 96 of the substrate 92 or only over selected area(s) most prone to attack and degradation. In other embodiments, two layers of tiles may be used, such as is illustrated in FIG. 5, with the materials of the two layers being the same or different. Furthermore, the thickness of the tiles 94 and/or layer of sealing material 100 may be varied across the surface 96 of the substrate 92 to accommodate local flow, erosion, or impingement conditions.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

The invention claimed is:

1. A damage tolerant apparatus for use in a hot combustion gas environment, the apparatus comprising:

a substrate;

a monolithic layer of ceramic insulating material disposed over a first portion of the substrate;

a plurality of individual tiles of ceramic insulating material disposed over a second portion of the substrate and defining gaps between adjacent tiles; and a grout deposited to fill the gaps as a barrier to passage of hot combustion gas through the gaps and effective to smooth a flow of the hot combustion gas across a top surface of the tiles and effective to blunt any crack tip extending from any of the individual tiles.

2. The apparatus of claim 1, wherein the grout is selected to have mechanical properties different than those of the tiles.

3. The apparatus of claim 2, wherein the grout comprises a ceramic material selected to have an elastic modulus that is lower than an elastic modulus of the ceramic insulating material of the tiles.

4. The apparatus of claim 1, wherein the grout comprises one of the group consisting of mullite, monazite, sheelite, and submicron blends of alumina-zirconia, alumina-hafnia, and alumina-ceria.

5. The apparatus of claim 1, wherein the tiles are selectively fired before being bonded to the substrate to control an amount of shrinkage experienced by the tiles after bonding.

6. The apparatus of claim 1, further comprising a layer of sealing material disposed over at least a portion of the plurality of individual tiles.

7. The apparatus of claim 1, further comprising a layer of sealing material disposed over at least a portion of the grout.

8. A damage tolerant apparatus for use in a hot combustion gas environment, the apparatus comprising;

a substrate;

a monolithic layer of ceramic insulating material disposed over a first portion of the substrate;

a plurality of individual tiles of ceramic insulating material disposed over a second portion of the substrate and defining gaps between adjacent tiles; and a grout deposited to fill the gaps as a barrier to passage of hot combustion gas through the gaps and effective to smooth a flow of the hot combustion gas across a top surface of the tiles and effective to blunt any crack tip extending from any of the individual tiles, wherein the grout is selected to have mechanical properties different than those of the tiles and comprises a ceramic material selected to have an elastic modulus that is lower than an elastic modulus of the ceramic insulating material of the tiles and comprises one of the group consisting of mullite, monozite, sheelite, and submicron blends of alumina-zirconia, alumina-hafnia, and alumina-ceria.

9. The apparatus of claim 8, wherein the tiles are selectively fired before being bonded to the substrate to control an amount of shrinkage experienced by the tiles after bonding.

10. The apparatus of claim 8, further comprising a layer of sealing material disposed over at least a portion of the plurality of individual tiles.

11. The apparatus of claim 8, further comprising a layer of sealing material disposed over a portion of the grout.

* * * * *